US008647056B2

(12) United States Patent
Holroyd

(10) Patent No.: US 8,647,056 B2
(45) Date of Patent: Feb. 11, 2014

(54) VARIABLE GEOMETRY TURBOMACHINE

(75) Inventor: Robert L. Holroyd, Stainland (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 0 days.

(21) Appl. No.: 13/489,084

(22) Filed: Jun. 5, 2012

(65) Prior Publication Data

US 2012/0286066 A1 Nov. 15, 2012

Related U.S. Application Data

(63) Continuation of application No. PCT/GB2010/002236, filed on Dec. 6, 2010.

(30) Foreign Application Priority Data

Dec. 5, 2009 (GB) ..... 0921350.5

(51) Int. Cl.
*F01D 17/16* (2006.01)

(52) U.S. Cl.
USPC ..... 415/164; 415/157; 415/209.3

(58) Field of Classification Search
USPC ..... 60/602; 415/157, 159, 164, 167, 208.2, 415/209.3
See application file for complete search history.

(56) References Cited

U.S. PATENT DOCUMENTS

| | | | | |
|---|---|---|---|---|
| 2,996,996 | A * | 8/1961 | Jassniker | 415/126 |
| 4,130,374 | A * | 12/1978 | Bingler | 415/131 |
| 4,557,665 | A * | 12/1985 | Szczupak | 415/158 |
| 4,718,819 | A * | 1/1988 | Rogo et al. | 415/149.1 |
| 5,231,831 | A * | 8/1993 | Leavesley | 60/602 |
| 5,868,552 | A | 2/1999 | McKean et al. | |
| 2004/0128997 | A1 | 7/2004 | Parker | |
| 2005/0262841 | A1 * | 12/2005 | Parker | 60/602 |
| 2006/0010864 | A1 | 1/2006 | Mulloy et al. | |

FOREIGN PATENT DOCUMENTS

| | | |
|---|---|---|
| DE | 4218229 | 3/1993 |
| EP | 0095853 | 12/1983 |
| EP | 0189364 | 7/1986 |

(Continued)

OTHER PUBLICATIONS

UKIPO Search Report, GB 0921350.5, Cummins Turbo Technologies Limited, Mar. 30, 2010.

(Continued)

*Primary Examiner* — Edward Look
*Assistant Examiner* — Liam McDowell
(74) *Attorney, Agent, or Firm* — Krieg DeVault LLP; Clifford W. Browning

(57) ABSTRACT

Variable geometry turbomachine with a bearing housing, an adjacent turbine housing, a turbine wheel rotating in the turbine housing about a turbine axis; an inlet passage upstream of the turbine wheel between inlet surfaces of first and second wall members, one wall member moveable along the turbine axis to vary the inlet passage size; vanes across the inlet passage connected to a first wall member; an array of vane slots defined by the second wall member to receive the vanes for relative movement between the wall members; the second wall member comprising a shroud defining vane slots; the second wall member supported by a support member retained by a mounting feature; the mounting feature being one of the bearing housings, the turbine housing, or the actuation element; and the shroud is fixed to the support member so axial movement of the shroud relative to the support member is substantially prevented.

19 Claims, 9 Drawing Sheets

(56) References Cited

FOREIGN PATENT DOCUMENTS

| | | |
|---|---|---|
| EP | 0654587 | 5/1995 |
| EP | 1900908 | 3/2008 |
| GB | 2271814 | 4/1994 |
| GB | 2458191 | 9/2009 |
| GB | 2462115 | 1/2010 |
| WO | WO 01/53679 | 7/2001 |
| WO | WO 2006/131724 | 12/2006 |
| WO | WO 2009/010711 | 1/2009 |

OTHER PUBLICATIONS

International Search Report and Written Opinion, PCT/GB2010/002236, Cummins Turbo Technologies Limited, Aug. 19, 2011.

* cited by examiner

Prior-Art

Prior-Art

Prior-Art

Prior-Art

VARIABLE GEOMETRY TURBOMACHINE

CROSS-REFERENCE TO RELATED APPLICATIONS

The present application is a continuation of PCT/GB2010/002236,filed Dec. 6, 2010, and claims priority from United Kingdom patent application 0921350.5, which is hereby incorporated by reference.

The present invention relates to a variable geometry turbomachine. Particularly, but not exclusively, the present invention relates to a variable geometry turbine for a turbocharger and to a method for assembling the turbomachine or turbine.

A turbomachine comprises a turbine. A conventional turbine comprises an exhaust gas driven turbine wheel mounted on a rotatable shaft within a turbine housing connected downstream of an engine outlet manifold. Rotation of the turbine wheel drives either a compressor wheel mounted on the other end of the shaft within a compressor housing to deliver compressed air to an engine intake manifold, or a gear which transmits mechanical power to an engine flywheel or crankshaft. The turbine shaft is conventionally supported by journal and thrust bearings, including appropriate lubricating systems, located within a bearing housing.

Turbochargers are well known devices for supplying air to the intake of an internal combustion engine at pressures above atmospheric pressure (boost pressures). Turbochargers comprise a turbine having a turbine housing which defines a turbine chamber within which the turbine wheel is mounted; an annular inlet passageway defined between opposite radial walls arranged around the turbine chamber; an inlet arranged around the inlet passageway; and an outlet passageway extending from the turbine chamber. The passageways and chambers communicate such that pressurised exhaust gas admitted to the inlet chamber flows through the inlet passageway to the outlet passageway via the turbine and rotates the turbine wheel. Turbine performance can be improved by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suite varying engine demands. For instance, when the volume of exhaust gas being delivered to the turbine is relatively low, the velocity of the gas reaching the turbine wheel is maintained at a level which ensures efficient turbine operation by reducing the size of the annular inlet passageway. Turbochargers provided with a variable geometry turbine are referred to as variable geometry turbochargers.

In one known type of variable geometry turbine, an array of vanes, generally referred to as a "nozzle ring", is disposed in the inlet passageway and serves to direct gas flow towards the turbine. The position of the nozzle ring relative to a facing wall of the inlet passageway is adjustable to control the axial width of the inlet passageway, either by moving the nozzle ring or the facing wall in an axial direction. Thus, for example, as gas flow through the turbine decreases, the inlet passageway width may be decreased to maintain gas velocity and optimise turbine output. This arrangement differs from another type of variable geometry turbine in which a variable guide vane array comprises adjustable swing guide vanes arranged to pivot so as to open and close the inlet passageway.

The nozzle ring may be provided with vanes which extend into the inlet and through vane slots provided in a "shroud" defining the facing wall of the inlet passageway to accommodate movement of the nozzle ring. Alternatively vanes may extend from the fixed facing wall and through vane slots provided in a moveable shroud.

Typically the nozzle ring may comprise a radially extending wall (defining one wall of the inlet passageway) and radially inner and outer axially extending walls or flanges which extend into an annular cavity behind the radial face of the nozzle ring. The cavity is formed in a part of the turbocharger housing (usually either the turbine housing or the turbocharger bearing housing) and accommodates axial movement of the nozzle ring. The flanges may be sealed with respect to the cavity walls to reduce or prevent leakage flow around the back of the nozzle ring.

In one common arrangement of a variable geometry turbine the nozzle ring is supported on rods extending parallel to the axis of rotation of the turbine wheel and is moved by an actuator which axially displaces the rods. Nozzle ring actuators can take a variety of forms, including pneumatic, hydraulic and electric and can be linked to the nozzle ring in a variety of ways. The actuator will generally adjust the position of the nozzle ring under the control of an engine control unit (ECU) in order to modify the airflow through the turbine to meet performance requirements.

As mentioned above, as the nozzle ring is moved to adjust the axial width of the inlet passageway, the guide vanes may extend into accurately defined vane slots in a shroud plate to accommodate the movement. Typically, shroud plates are made by turning from bar, where each plate is essentially a disc of material, often provided with a relatively thick outer periphery with a circumferential groove to accommodate a locating ring which retains the disc within the turbine housing. After turning, the vane slots are usually produced in the disc, one at a time, by numerical control (NC) laser cutting. In order to ensure efficient functioning of the nozzle ring and shroud plate assembly it is important that the size, shape and position of the vane slots accurately matches that of the guide vanes. This introduces very fine tolerances to the manufacture of both the shroud plate and the nozzle ring carrying the guide vanes. Production of shroud plates and nozzle rings is therefore an undesirably complicated and costly process requiring very careful control of a number of different manufacturing processes to ensure the two components function together satisfactorily. The locating ring is designed to move axially and/or rotate in the circumferential groove of the shroud plate and/or a similar groove in the turbine housing. This movement can cause undesirable wear in the grooves.

It is an object of the present invention to obviate or mitigate one or more of the problems set out above.

According to a first aspect of the present invention there is provided a variable geometry turbomachine comprising: a housing which defines a bearing housing and an adjacent turbine housing; a turbine wheel supported in the turbine housing for rotation about a turbine axis; an annular inlet passage upstream of said turbine wheel defined between respective inlet surfaces of first and second wall members, at least one of said first and second wall members being moveable by an actuation element along the turbine axis to vary the size of the inlet passage; an array of vanes extending across the inlet passage, said vanes being connected to said first wall member; a complementary array of vane slots defined by the second wall member, said vane slots being configured to receive said vanes to accommodate relative movement between the first and second waif members; wherein the second wall member comprises a shroud which defines said vane slots; the second wall member being supported by a support member; wherein a portion of the support member is configured to be received by a corresponding mounting feature such that the support member is retained by the mounting feature; wherein the mounting feature is provided by one of the bearing housing, the turbine housing or the actuation element; and wherein the shroud is fixed to the support member such that axial movement of the shroud relative to the support member is substantially prevented.

In some embodiments the shroud is fixed to the support member by at least one fixing element, such as, for example, at least one rivet, screw bolt or other suitable fixing. Alternatively the shroud may be attached by welding or otherwise bonding.

In some embodiments the at least one fixing element protrudes towards the first wall member, and the at least one fixing element may, provide a limit of travel of the first and second wall members relative to one another by coming into abutment with the first wall member.

The support member may comprise at least one axial hole and the shroud may comprise at least one corresponding axial hole. The shroud may be fixed to the support member by at least one fixing element being received by both the at least one hole in the support member and the at least one corresponding hole in the shroud.

The shroud may comprise a generally annular plate which may be substantially planar.

This simple structure allows it to be produced by, for example, fine-blanking. The slots in the shroud may be produced in the same fine-blanking process.

The mounting feature of the bearing housing, turbine housing or actuation element may comprise a substantially annular groove.

The support member may be generally ring-shaped.

The support member may be resilient enabling the support member to be compressed to a smaller size and then returned to its original size. This resilience may be provided by a discontinuity in the general ring-shape that may be reduced in size by compression of the support member.

The shroud may be axially adjacent to the support member and more preferably immediately axially adjacent thereto such that it is in abutment therewith.

The support member may support the shroud at the outer periphery of the shroud. The support member may comprise at least one inwardly directed protuberance relative to the axis that serves to support the shroud. The or each inwardly directed protuberance may have an aperture by which the shroud is fixed to the support member with the fixing element.

An outer diameter of the support member may be greater than an outer diameter of the shroud. An inner diameter of the shroud may less than a minimum inner diameter of the support member.

In some embodiments the mounting feature and/or the support member is/are adapted to accommodate a degree of relative rotational and/or axial movement between the support member and either of the bearing housing, turbine housing or actuation member which provides the mounting feature.

In some embodiments the shroud is fixed to the support member such that rotation of the shroud relative to the support member is substantially prevented.

The minimum inner diameter of the support member may be less than an outer diameter of the shroud.

In some embodiments the at least one fixing element is adapted to allow a degree of relative non-axial movement between the support member and the shroud. This may be a radial movement to accommodate differential thermal expansion. Alternatively, or in addition, the holes in the shroud and/or the support member may be sized to allow radial movement relative to the fixing element(s).

In some embodiments the turbomachine is a turbocharger.

According to a second aspect of the present invention, there is provided a variable geometry turbine comprising a housing; a turbine wheel supported in the housing for rotation about a turbine axis; an annular inlet passage upstream of said turbine wheel defined between respective inlet surfaces of first and second wall members, at least one of said first and second wall members being moveable by an actuation element along the turbine axis to vary the size of the inlet passage; an array of vanes extending across the inlet passage, said vanes being connected to said first wall member; a complementary array of vane slots defined by the second wall member, said vane slots being configured to receive said vanes to accommodate relative movement between the first and second wall members; wherein the second wall member comprises shroud which defines said vane slots; the second wall member being supported by a support member; wherein a portion of the support member is configured to be received by a corresponding mounting feature of the housing or actuation element such that the support member is retained by the mounting feature; and wherein the shroud is fixed to the support member such that axial movement of the shroud relative to the support member is substantially prevented.

According to a further aspect of the present invention, there is provided a method of assembling a variable geometry turbine having a housing defining a turbine chamber for receipt of a turbine wheel for rotation about a turbine axis, an annular inlet passage upstream of said turbine chamber, and a variable geometry mechanism for varying the size of the inlet passageway in the direction of the axis, the mechanism comprising an actuation element, an array of vanes extending across the inlet passage, and a shroud configured to receive said vanes and accommodate relative axial movement between the shroud and the vanes; the method comprising: inserting a support member into either the housing or the actuation element such that a mounting feature of the respective housing or actuation element receives a portion of the support member; and with the portion of the support member received in the mounting feature, fixing a shroud to the support member such that axial movement of the shroud relative to the support member is substantially prevented.

In some embodiments the method additionally comprises deforming the support member prior to the mounting feature receiving the portion of the support member and allowing it to expand once received in the mounting feature.

In some embodiments the shroud is fixed to the support member by at least one fixing element.

The method of assembly defined above may be applied to a turbine having any of the features described above in relation to the first and second aspects of the invention Other advantageous and preferred features of the invention will be apparent from the following description.

Specific embodiments of the present invention will now be described, by way of example only, with reference to the accompanying drawings, in which:

FIG. 1 is an axial cross-section through a known variable geometry turbocharger;

FIG. 2*a* is a front view of a prior art shroud plate for use in a variable geometry turbine;

FIG. 2*b* is a cross-sectional view taken along line G-G of the shroud plate of FIG. 2*a*;

Figure 4:
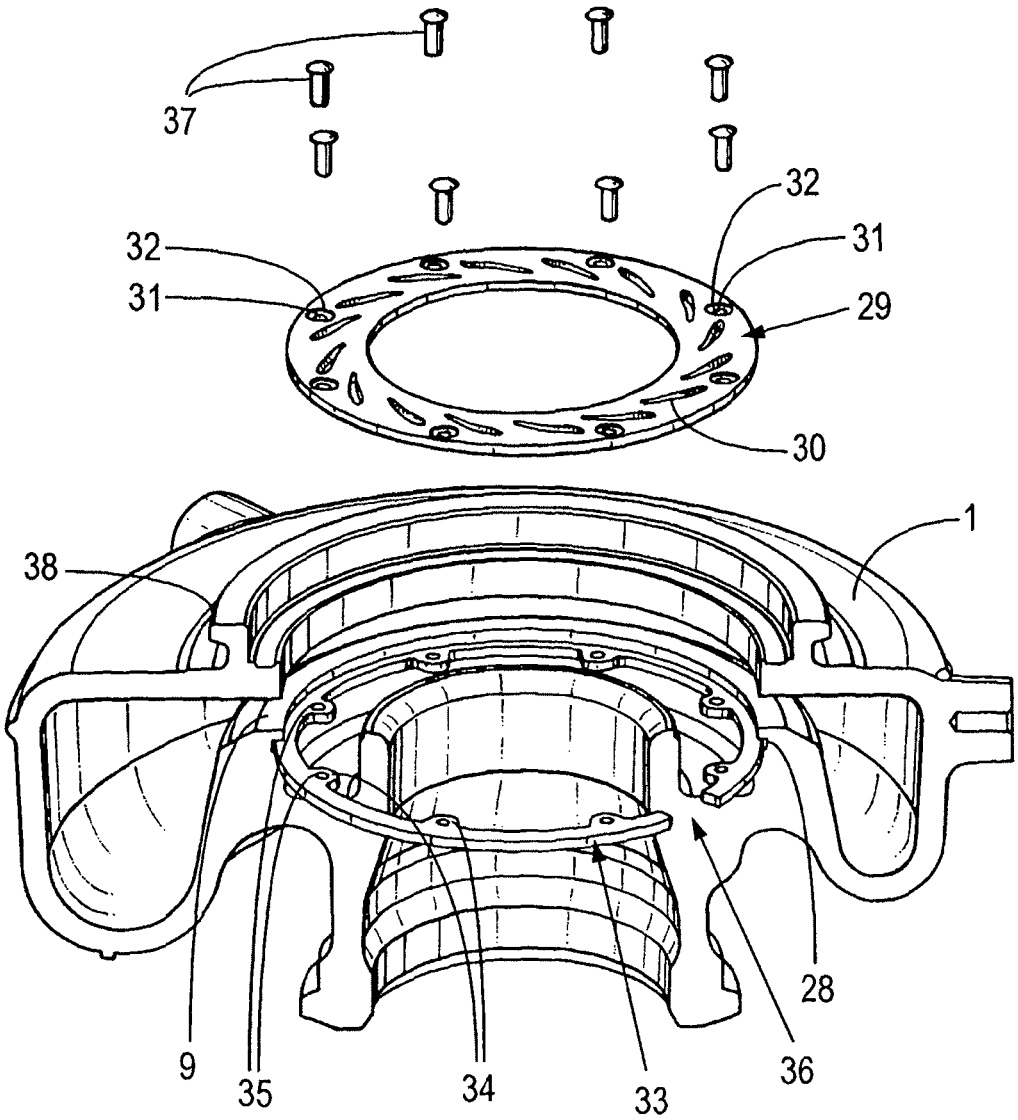
FIG. 4 is an exploded, perspective view of a turbine housing, support member and shroud plate in accordance with a first embodiment of the invention, with part of the turbine housing cut away to aid clarity.
Figure 5:
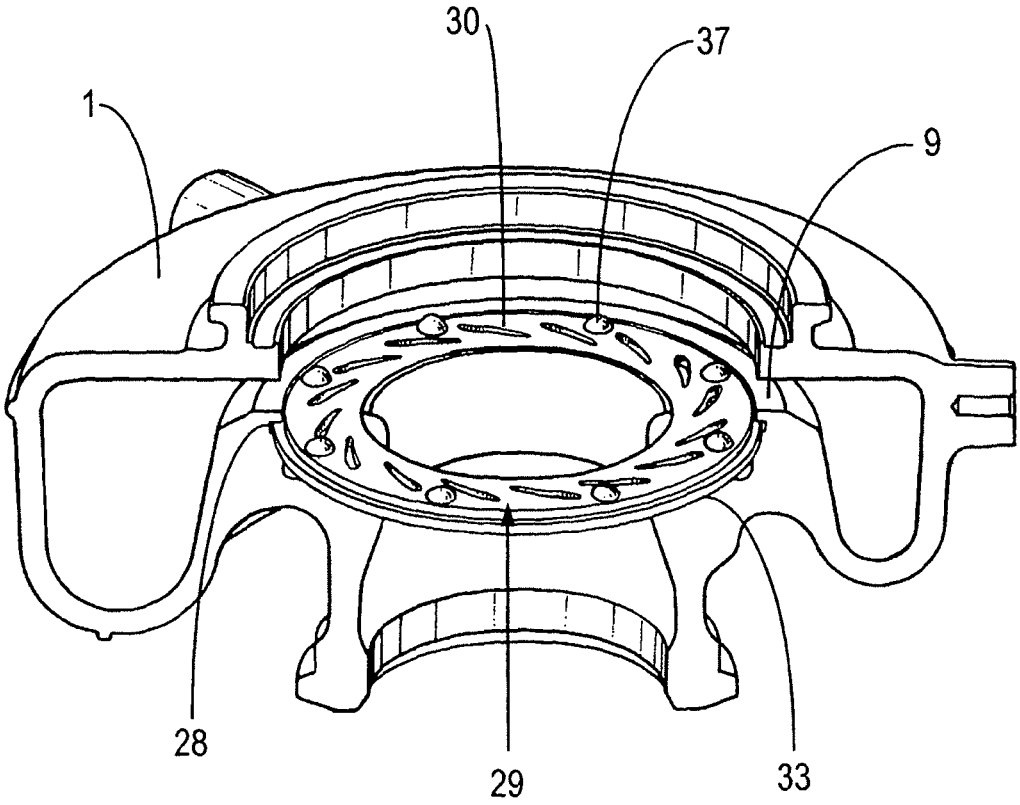
FIG. 5 is a perspective view of the turbine housing, support member and shroud plate of FIG. 4, shown when assembled, with part of the turbine housing cut away to aid clarity.
Figure 6:
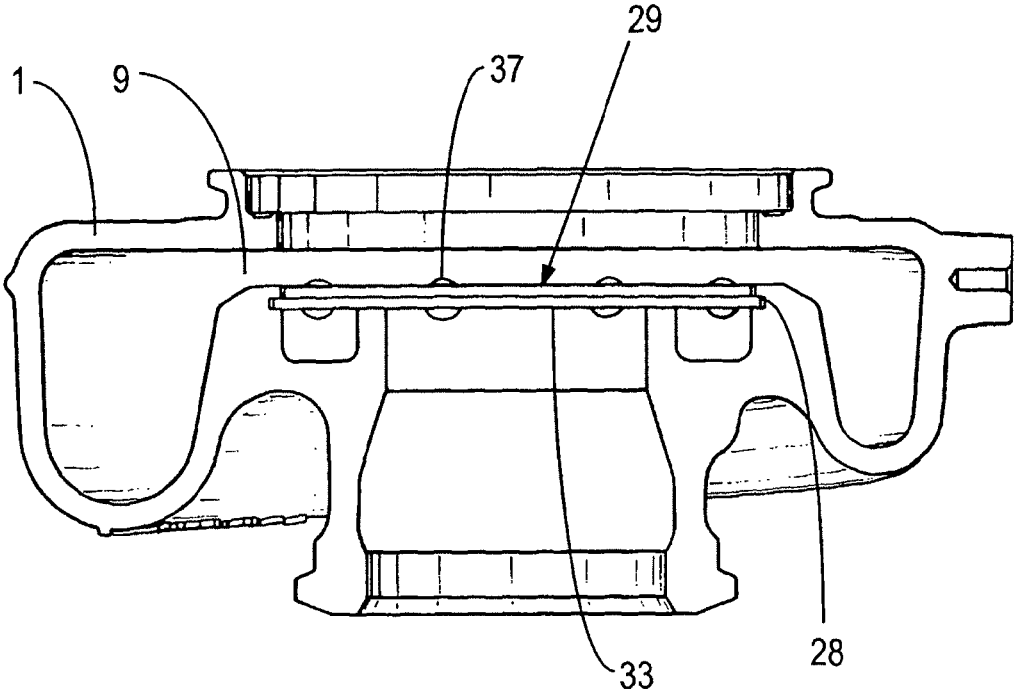
FIG. 6 is a side elevation of the assembled turbine housing, support member and shroud plate shown in FIG. 4, with part of the turbine housing removed for clarity.
Figure 7A:
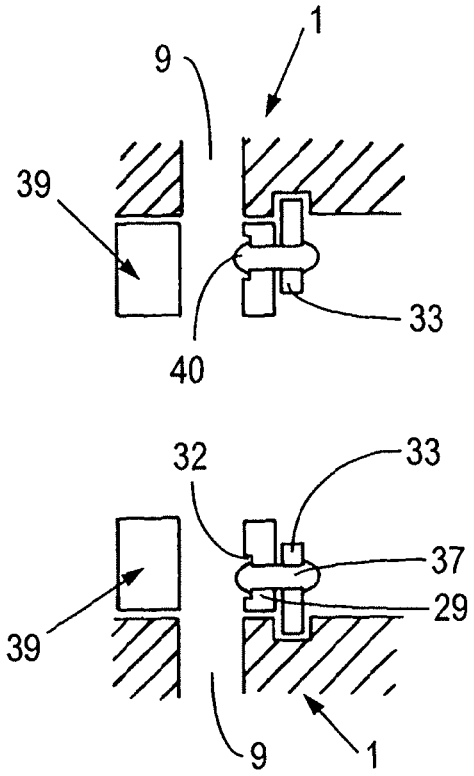
Figure 7B:
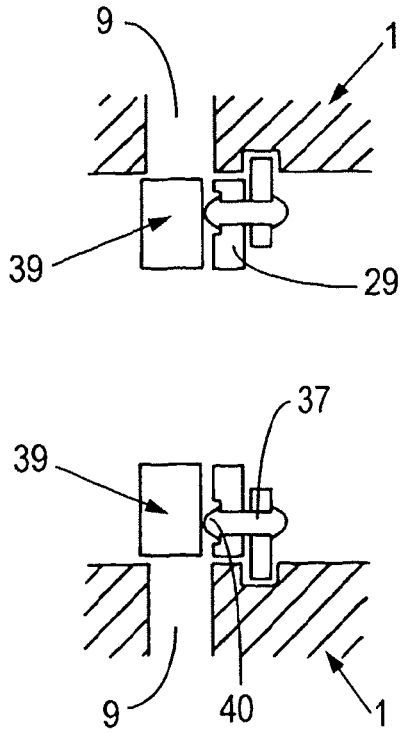
Figure 8:
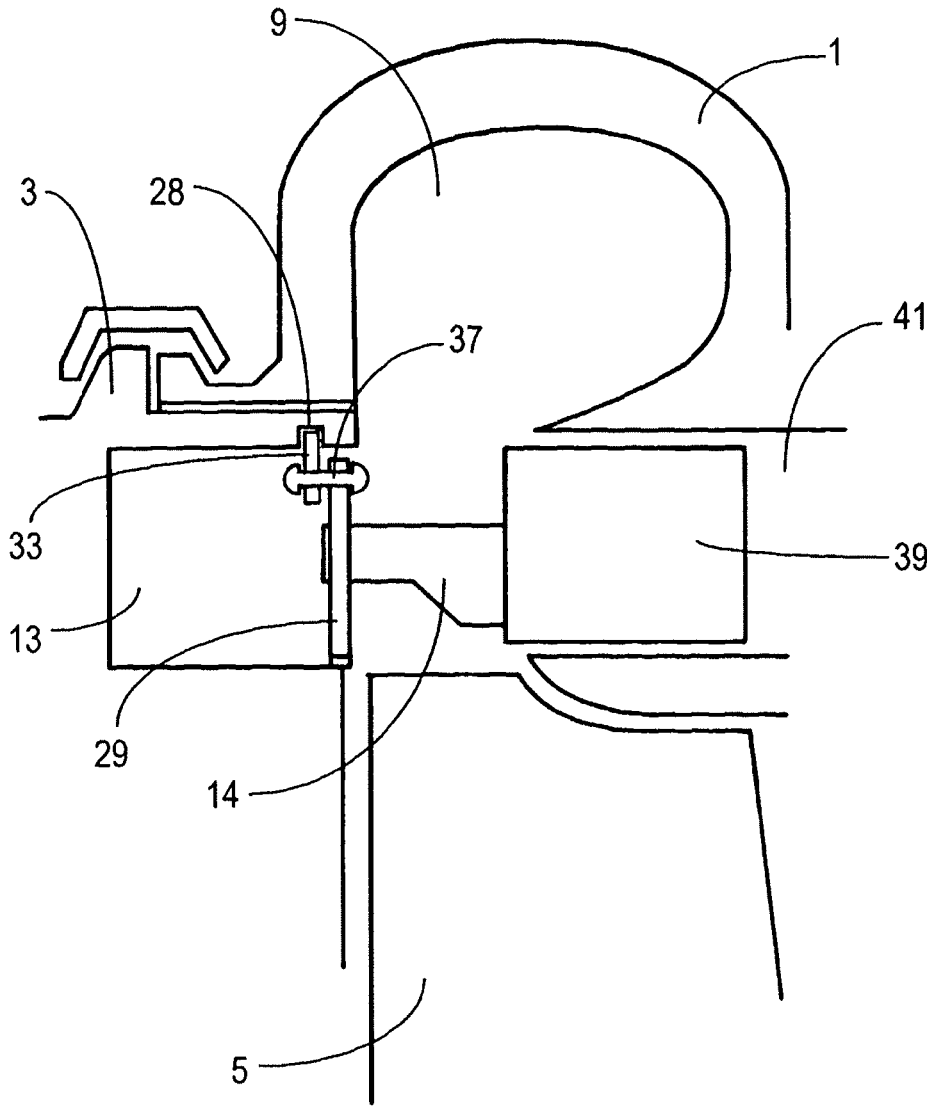
Figure 9:
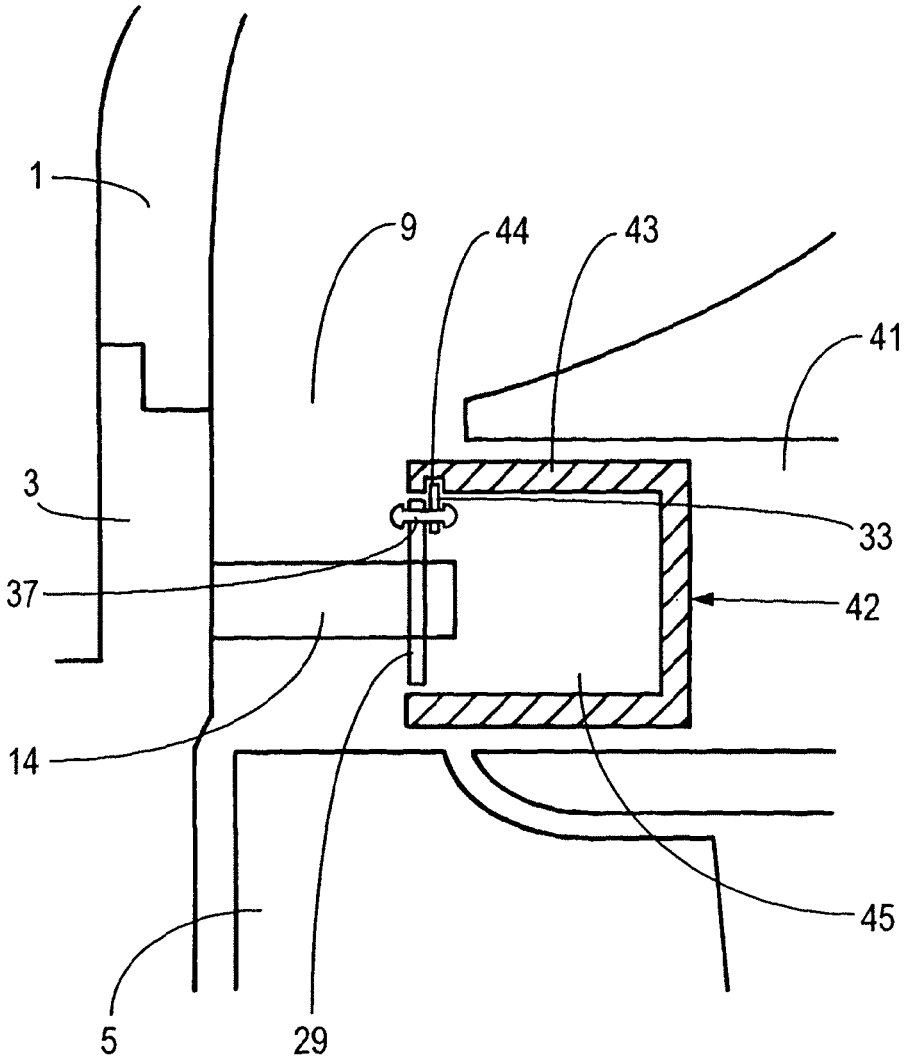

FIG. 7*a* is a schematic axial cross section through part of the turbine housing in accordance with the embodiment of the invention shown in FIGS. 4 to 6, showing a nozzle ring in an open position;

FIG. 7*b* is a schematic axial cross section through part of the turbine housing as shown in FIGS. 4 to 6, showing the nozzle ring in a closed position;

FIG. 8 is a schematic axial cross section through part of a bearing housing and a turbine of a turbocharger in accordance with a second embodiment of the present invention; and FIG. 9 is a schematic axial cross section through part of a bearing housing and a turbine of a turbocharger in accordance with a third embodiment of the invention.

Figure 1:
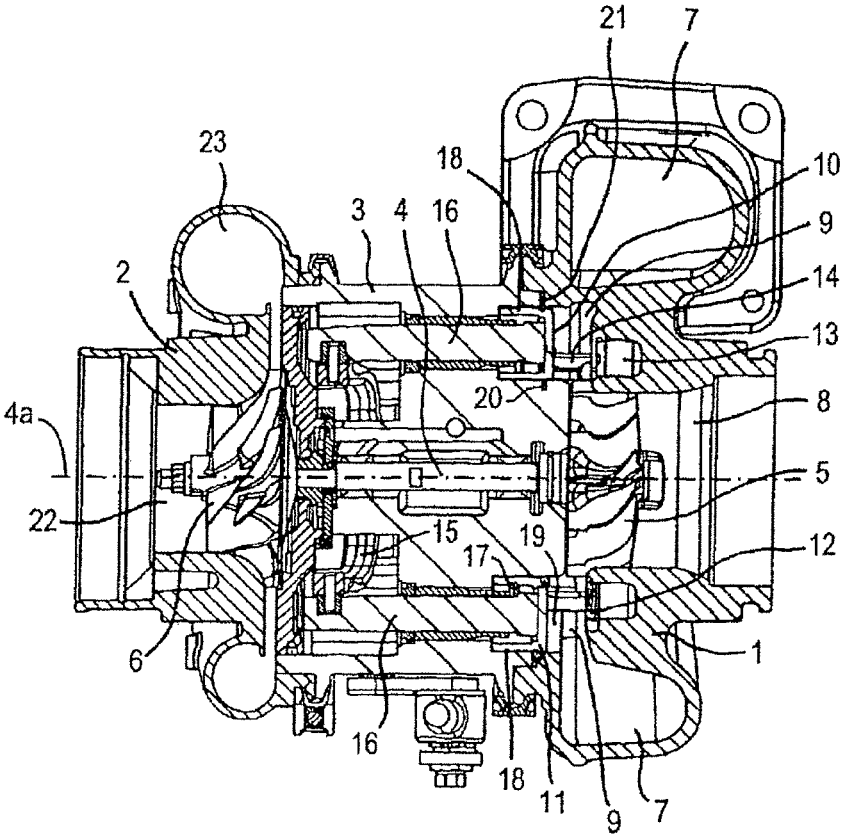

Referring to FIG. 1, this illustrates a known variable geometry turbocharger comprising a variable geometry turbine housing 1 and a compressor housing 2 interconnected by a central bearing housing 3. A turbocharger shaft 4 extends from the turbine housing 1 to the compressor housing 2 through the bearing housing 3. A turbine wheel 5 is mounted on one end of the shaft 4 for rotation within the turbine housing 1, and a compressor wheel 6 is mounted on the other end of the shaft 4 for rotation within the compressor housing 2. The shaft 4 rotates about turbocharger axis 4*a* on bearing assemblies located in the bearing housing 3.

The turbine housing 1 defines an inlet volute 7 to which gas from an internal combustion engine (not shown) is delivered. The exhaust gas flows from the inlet volute 7 to an axial outlet passageway 8 via an annular inlet passageway 9 and the turbine wheel 5. The inlet passageway 9 is defined on one side by a face 10 of a radial wall of a movable annular wall member 11, commonly referred to as a "nozzle ring", and on the opposite side by a second wall member comprising an annular shroud 12 which forms the wall of the inlet passageway 9 facing the nozzle ring 11. The shroud 12 covers the opening of an annular recess 13 in the turbine housing 1.

The nozzle ring 11 supports an array of circumferentially and equally spaced inlet vanes 14 each of which extends across the inlet passageway 9. The vanes 14 are orientated to deflect gas flowing through the inlet passageway 9 towards the direction of rotation of the turbine wheel 5. When the nozzle ring 11 is proximate to the annular shroud 12, the vanes 14 project through suitably configured slots in the shroud 12, into the recess 13.

The position of the nozzle ring 11 is controlled by an actuator assembly of the type disclosed in U.S. Pat. No. 5,868,552. An actuator (not shown) is operable to adjust the position of the nozzle ring 11 via an actuator output shaft (not shown), which is linked to a yoke 15. The yoke 15 in turn engages axially extending actuating rods 16 that support the nozzle ring 11. Accordingly, by appropriate control of the actuator (which may for instance be pneumatic or electric), the axial position of the rods 16 and thus of the nozzle ring 11 can be controlled. The speed of the turbine wheel 5 is dependent upon the velocity of the gas passing through the annular inlet passageway 9. For a fixed rate of mass of gas flowing into the inlet passageway 9, the gas velocity is a function of the width of the inlet passageway 9, the width being adjustable by controlling the axial position of the nozzle ring 11. FIG. 1 shows the annular inlet passageway 9 fully open. The inlet passageway 9 may be closed to a minimum by moving the face 10 of the nozzle ring 11 towards the shroud 12.

The nozzle ring 11 has axially extending radially inner and outer annular flanges 17 and 18 that extend into an annular cavity 19 provided in the turbine housing 1. Inner and outer sealing rings 20 and 21 are provided to seal the nozzle ring 11 with respect to inner and outer annular surfaces of the annular cavity 19 respectively, whilst allowing the nozzle ring 11 to slide within the annular cavity 19. The inner sealing ring 20 is supported within an annular groove formed in the radially inner annular surface of the cavity 19 and bears against the inner annular flange 17 of the nozzle ring 11. The outer sealing ring 20 is supported within an annular groove formed in the radially outer annular surface of the cavity 19 and bears against the outer annular flange 18 of the nozzle ring 11.

Gas flowing from the inlet volute 7 to the outlet passageway 8 passes over the turbine wheel 5 and as a result torque is applied to the shaft 4 to drive the compressor wheel 6. Rotation of the compressor wheel 6 within the compressor housing 2 pressurises ambient air present in an air inlet 22 and delivers the pressurised air to an air outlet volute 23 from which it is fed to an internal combustion engine (not shown).

Figure 2A:
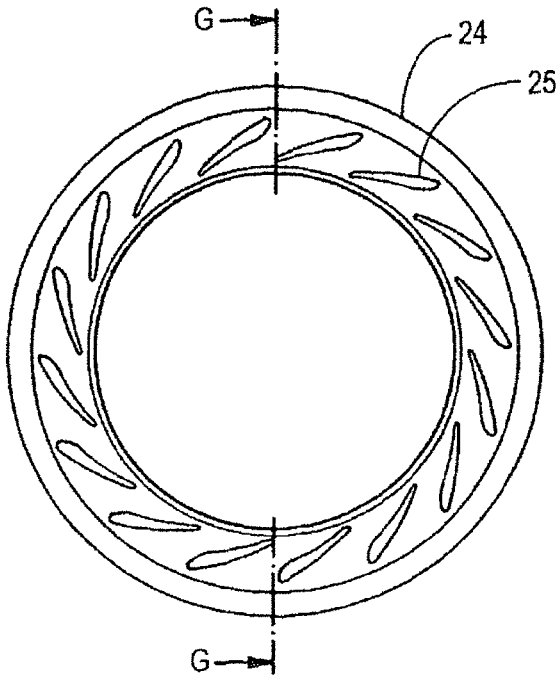
Figure 2B:
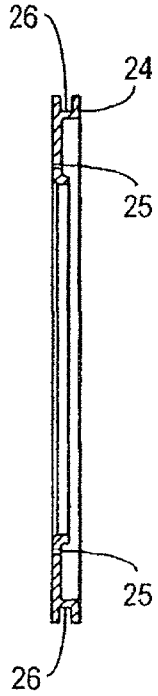

Referring to FIGS. 2*a* and 2*b*, there is shown a prior art shroud plate for use in a variable geometry turbine. The shroud plate 24 is annular in shape and defines an annular array of vane slots 25 for receipt of vanes attached to a nozzle ring of a variable geometry turbine of the kind shown in FIG. 1. The relative positioning of each vane slot 25 compared to the other vane slots 25 and the cross-sectional shape of each vane slot 25 should be very carefully controlled so as to ensure that each vane is correctly received within its respective vane slot 25 whilst also ensuring that disturbance to airflow passing over the vane slots 25 is minimised. The shroud plate 24 must therefore be manufactured to very high intolerances both in terms of the shape and position of each vane slot 25 to ensure proper functioning of the shroud plate 24 in combination with the nozzle ring (not shown). The shroud plate 24 defines a circumferential slot 26 which extends around the radially outermost edge of the shroud plate 24.

The shroud plate 24 is manufactured by turning from bar. Once a blank disc has been formed, an inner portion is reduced in thickness and the circumferential slot 26 is then cut into the radially outer (thicker) edge of the disc. The plate is substantially 'h' shaped in section as can be seen from FIG. 2B. The vane slots 25 are then cut through the disc using, for example, laser cutting. Commonly, the vane slots 25 are cut sequentially, i.e. one at a time, making the manufacturing process relatively lengthy and expensive.

Figure 3:
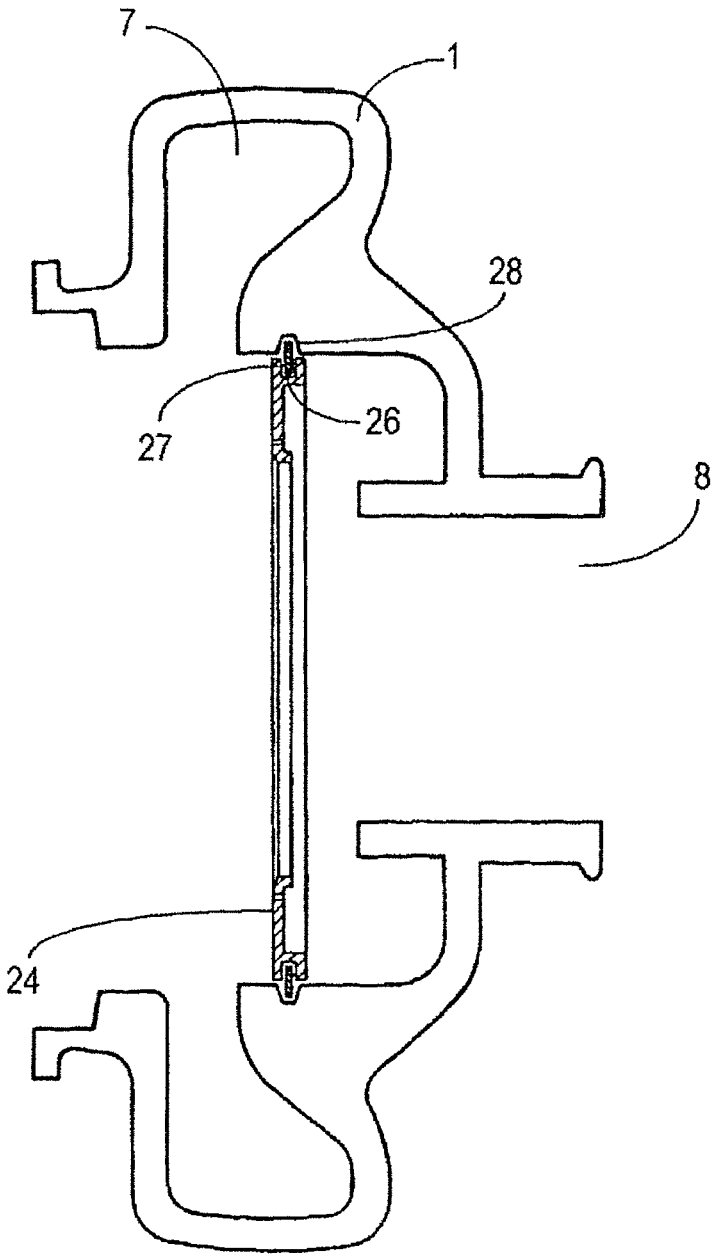
FIG. 3 is a schematic axial cross-section through a turbine housing of the known variable geometry turbocharger shown in FIG. 1, the turbine housing having been removed from the rest of the turbocharger for clarity.

Referring to FIG. 3, there is shown the prior art shroud plate described above installed in a known variable geometry turbine housing 1. The slot 26 of the shroud plate 24, in the widest part of the 'h' shape, receives a ring 27. The turbine housing 1 comprises a correspondingly sized wedge-shaped circumferential groove 28. In order to support the shroud plate 24 within the turbine housing 1, the ring 27 is located in the slot 26 of the shroud plate 24, and the shroud plate 24 and ring 27 are together inserted into the turbine housing 1 such that the ring 27 locates within the groove 28. The ring 27 is typically a split piston ring type that also provides sealing of the shroud to the turbine housing 1. In order to locate the ring 27 within the groove 28 (and hence the shroud plate 24 within the turbine housing 1), an inwardly directed force is applied to the ring 27 whilst it is disposed in the slot 26 such that the ring 27 is compressed and its diameter reduced, hence allowing the ring 27 to slide along the turbine housing 1 and enter the groove 28. The location of the shroud plate 24 and ring 27 in this manner is not an easy process to perform as the space available to compress the ring whilst it is on the shroud plate is limited.

The ring 27 is free to move axially and/or rotate in the circumferential slot 26 of the shroud plate 24 and/or the groove 28 in the turbine housing 1. This movement of the ring 27 allows the shroud plate 24 to move axially and/or rotate relative to the turbine housing 1. The rotation of the shroud plate 24 relative to the turbine housing 1 allows the shroud plate 24 to move such that the vane slots 25 align with vanes of the nozzle ring as the width of the inlet passageway is changed. The movement of the ring 27 relative to the slot 26 and/or groove 28 may cause undesirable wear of any of the slot 26, groove 28 or ring 27. Such wear may result in reduced sealing between the shroud plate 24 and the turbine housing 1. Furthermore, said wear may cause the shroud plate 24 to move out of its correct position. For example, wear may cause a step (not shown) to be formed in the wedge shaped groove 28 or slot 26. Due to the relatively small mass of the shroud plate 24 and ring 27 compared to the turbine housing 1, the turbine housing 1 experiences thermal lag with respect to the shroud plate 24 and ring 27 when the turbine housing, shroud plate and ring are exposed to a change in temperature, i.e. the shroud plate 24 and ring 27 heat up and cool down faster than the turbine housing 1 and hence the shroud plate 24 and ring 27 expand and contract faster than the turbine housing. In some circumstances, as the turbocharger cools down, the shroud plate 24 and ring 27 contract and locate within a step in the groove 28 or slot 26 formed by wear. As the turbine housing 1 cools and contracts more slowly than the shroud plate and ring, the diameter of the groove 28 (including any step) will reduce which may put stress on the shroud plate 24 and ring 27. In extreme cases, the stress on the shroud plate 24 and ring 27 may cause the shroud plate 24 to fracture.

FIGS. 4, 5 and 6 show a turbine comprising a shroud plate 29 in accordance with an embodiment of the present invention. The turbine housing 1 shown is very similar to that of the above prior art and also comprises a groove 28. The shroud plate 29 is a generally planar, annular plate which defines an annular array of vane slots 30 for receipt of vanes attached to a nozzle ring of a variable geometry turbine of the kind shown in FIG. 1. The vane slots 30 may have any appropriate orientation and spacing so as to be complementary to the nozzle ring vanes. The shroud plate 29 additionally comprises a plurality of apertures 31 which pass through the shroud plate and are equally spaced around the circumference of the shroud plate 29. The apertures pass through the shroud plate in a direction which is perpendicular to the plane of the shroud plate 29, however, any appropriate configuration of aperture which passes through the shroud plate 29 may be used. Each aperture 31 is surrounded on one side of the shroud plate 29 by a counterbore 32.

In accordance with the present invention there is also provided a support member 33. FIG. 4 shows the support member 33 in situ. In the current embodiment the support member is a generally planar, discontinuous ring that defines a gap 36 such that it is substantially or approximately C-shaped. The support member 33 comprises a plurality of circumferentially spaced, radially inward projecting protuberances 34. Each protuberance 34 has an aperture 35 which passes through approximately the centre of the protuberance 34 in a direction perpendicular to the plane of the support member 33. Each protuberance 34 and associated aperture 35 are positioned and sized such that when the shroud plate 29 is in situ, each aperture 35 may align with a corresponding aperture 31 in the shroud plate 29.

The shroud plate 29 and support member 33 are assembled into the turbine housing 1 as follows. Whilst the turbine housing 1 is separated from the bearing housing, the support member 33 is inserted into the turbine housing 1 from the bearing housing end of the turbine housing 1. The structure of the support member 33 is resilient such that it deforms when compressed inwardly. In particular, a compressive force may be applied to the outer periphery of the support member 33 either side of the gap 36 such the support member 33 flexes and the size of the gap 36 is reduced. In this way, a compressive force is applied to the support member 33 such that the diameter of the support member 33 is temporarily reduced, allowing the support member 33 to pass in to the turbine housing 1 and locate in groove 28.

Once in the groove 28, the compressive force on the support member 33 is removed. The resilient nature of the support member 33 means that upon removal of the compressive force, the support member expands towards its original size. The diameter of the support member will increase until the support member 33 reaches its uncompressed size or until it contacts the bottom of the groove 28 with sufficient force such that the reaction force between the turbine housing 1 and support member 33 is great enough to overcome the resilience of the support member 33. The groove 28 forms a mounting feature in the turbine housing which can receive the support member 33. In some embodiments, the outside diameter of the uncompressed support member 33 may be significantly larger than that of the internal diameter of the groove 28. In this case, the reaction force between the support member 33 and the bottom of the groove would be relatively high, resulting in the friction between the support member 33 and bottom of the groove 28 (and hence the turbine housing 1) being relatively high, thus providing a relatively high resistance to relative movement between the support member 33 and the turbine housing 1. The relative movement may be rotational or movement along the axis of the turbocharger. In other embodiments, the outside diameter of the uncompressed support member 33 may be smaller than that of the internal diameter of the groove 28. In this case, when the support member 33 is in situ in the groove 28, the support member 33 does not contact the bottom of the groove 28 with any force and as such the support member 33 is free to move relative to the turbine housing 1.

In either of the embodiments described above, when the support member 33 is received by the groove 28, the uncompressed support member 33 expands to a size such that it is not possible to move the support member 33 in any direction within the plane containing the support member 33 such that the support member 33 comes out of the groove 28. Because the support member 33 is always within the groove 28, the degree to which the support member 33 can be moved in a direction perpendicular to the plane which contains it (i.e. in a direction parallel to the turbocharger axis) is limited by abutment of the support member 33 with the sides of the groove 28.

In some embodiments the support member 33 may be compressed, inserted into the turbine housing 1 and allowed to expand at a position adjacent to the groove 28. The support member 33 will expand such that it abuts the turbine housing 1 adjacent the groove 28. If the support member 33 is then pushed in a direction substantially parallel to the turbocharger axis towards the groove 28, once the support member 33 moves into the groove 28 it will expand to a larger size and will be retained within the groove 28. As such, the fit of the support member within the groove and hence the turbine housing 1 may be referred to as a 'snap-fit'.

The support member 33 can be received by an existing groove 28 in a prior art turbine housing 1. It may therefore be possible to retrofit the support member 33 and shroud plate 29 of the present invention to existing turbochargers.

Once the support member 33 has been received by the turbine housing 1, the shroud plate 29 is inserted into the turbine housing 1 from the bearing housing end of the turbine housing 1. The shroud plate 29 has a smaller outside diameter than the support member 33 and as such may pass into the turbine housing 1 unobstructed. The radially inward projecting protuberances 34 extend to a position which is radially inbound of the outside diameter of the shroud plate 29. Thus when the shroud plate 29 is inserted into the turbine housing 1 and it cannot pass through the support member 33. The shroud plate 29 is arranged so that it is coaxial with the support member 33, rests axially adjacent and is rotated such that the apertures 31 of the shroud plate 29 are aligned with the corresponding apertures 35 in the support member 33. The shroud plate 29 of the current embodiment is inserted into the turbine housing such that the side without the counterbores 32 is adjacent the support member 33 and hence the side of the shroud plate 29 with the counterbores faces the bearing housing end of the turbine housing 1.

Once apertures 31 and 35 are aligned, the shroud plate 29 and support member 33 are fixed together by rivets 37 that are inserted into each corresponding pair of apertures 31, 35 from the bearing housing end of the turbine housing 1. The assembled turbine housing 1, support member 33 and shroud plate 29 can be seen best in FIGS. 5 and 6. Because the support member 33 has limited movement relative to the turbine housing 1 (as the support member 33 is received at least in part by the groove 28), when the shroud plate 29 is riveted to the support member 33 the movement of the shroud plate 29 relative to the bearing housing 1 is limited as a result.

Once the shroud plate 29 has been secured by the rivets 37, the turbine housing 1 can be mounted to the bearing housing as is well known to those skilled in the art. The turbine housing 1 may be mounted to the bearing housing by clamping a circumferential flange 38 of the turbine housing 1 to a corresponding circumferential flange (not shown) of the bearing housing using a V-band (not shown) or the like. As with the prior art, the vanes on the nozzle ring and the vane slots 30 of the shroud plate 29 are aligned before the turbine housing and bearing housing are secured together so that when the nozzle ring is proximate the shroud plate 29 the vanes are received by the corresponding vane slots.

The shroud plate 29 and its mounting within the turbine housing 1 using the support member 33 is advantageous when compared to the prior art. First, both the shroud plate 29 and the support member 33 are generally flat and as such can be produced by a fine blanking process. This is much less complex and costly than manufacturing the relatively complex shape of the prior art shroud plate by turning it from bar, having a circumferential slot cut into it and then having the vane slots cut through the disc using laser cutting. Secondly, as the support member 33 does not rotate relative to the shroud plate 29, the support member 33 is much less likely to cause wear of the shroud plate. The ring 27 used in the prior art is able to rotate relative to both the shroud plate and the turbine housing. In this way, ring 27 could cause wear to both the slot in the shroud plate and the groove in the bearing housing. The support member of the present invention does not rotate relative to the shroud, only relative to the housing and so it follows that the present invention reduces the wear interfaces involved in supporting the shroud plate from two in the prior art to one. Reducing the number of wear interfaces will reduce the overall wear on those parts of the turbomachine which mount the shroud plate within the housing. As such wear may result in reduced sealing between the shroud plate 24 and the turbine housing 1 and cause the shroud plate 24 to move out of its correct position, a reduction in wear reduces the likelihood of such an occurrence. Furthermore, by reducing the likelihood of the shroud plate moving out of its correct position, the likelihood of the shroud plate being fractured is reduced.

It is believed that the use of a support member 33 which is circumferentially discontinuous may provide a preferential gas leak path to the rear of the shroud for gas passing through the inlet passageway. Such a preferential gas leak path would result in differing gas flow conditions at different positions around the turbine inlet. In certain embodiments this may cause or exacerbate high cycle fatigue in the turbine blades which may result in premature wear and failure of the turbine wheel. These effects may be mitigated in several ways. First, the discontinuity in the support member can be reduced. Secondly, a support member may be designed such that, when in-situ in the groove, its two ends overlap. This may be achieved by using a support member which has ends which are of reduced thickness compared to the main body of the support member. Thirdly, alternative leak paths from one side of the shroud plate to the other may be provided.

The turbine housing and components within it are exposed to very high temperatures when the turbocharger is in operation. The manner in which the shroud plate is secured within the turbine housing may help to minimise any problems which may be caused by thermal expansion. For example, if the shroud plate, support member and turbine housing expand at different rates, stress may be placed on one or all of the components, which may in extreme cases cause them to break. If the support member is received loosely within the groove then this will provide space for the expansion of the support member relative to the turbine housing. Furthermore, its discontinuous form in combination with its ability to flex resiliently will enable the support member to resiliently deform within the groove should it expand at a greater rate to the turbine housing. It will then return to its original shape when the heat causing the expansion is removed. In addition, the rivets (or any other appropriate fixing) may secure the shroud plate to the support member in such a manner that a degree of relative expansion between the support member and the shroud plate can be accommodated.

In some embodiments the shroud plate 29 and support member 33 are made by fine blanking from a metal, such as 430 ferritic steel or 300 series austenitic steels (for example, 304L). In other embodiments the shroud plate 29 and support member 33 may be made using any appropriate fabrication method and made out of any appropriate material. In some embodiments the support member may be treated to resist wear. Possible wear resistance treatments include coatings (for example, physical vapour deposition coatings) and diffusion type wear resistance treatments.

FIGS. 7*a* and 7*b* show a schematic axial cross section through part of the turbine housing 1 once the turbine housing has been mounted to the bearing housing (not shown). As with the prior art, the nozzle ring 39 extends from the bearing housing into the turbine housing 1. The vanes on the nozzle ring 39 are not shown to aid clarity.

In FIG. 7*a*, the nozzle ring 39 is shown in an open position in which the inlet passageway 9 is substantially unobstructed. The shroud plate 29 and support member 33 have been riveted together by rivets 37 such that each rivet 37 has a head 40 which is received by the counterbore 32.

FIG. 7*b* shows the nozzle ring 39 in a closed position in which the nozzle ring 39 substantially obstructs the inlet passageway 9. In the closed position, the nozzle ring 39 abuts the heads 40 of the rivets 37 such that the rivet heads define a minimum separation between the nozzle ring 39 and the shroud plate 29 and hence also define a maximum possible obstruction of the inlet passageway 9. In some embodiments, the ability to define a maximum possible obstruction of the inlet passageway 9 is beneficial because in some instances, if the obstruction of the inlet passageway 9 is too great, this may generate excessive back pressure and over pressurise the engine cylinders. Using the rivet heads 40 to define the maximum obstruction of the inlet passageway 9 enables precise control in an accurate predictable manner of the level of the minimum gas flow through the turbine when the inlet is closed to a minimum. In some embodiments it is desirable to set the minimum separation between the shroud plate 29 and nozzle ring 39 to between 0.3 mm and 0.5 mm. It is possible to control the extent to which the rivet head 40 extends from the shroud plate 29 (and hence the minimum separation between the shroud plate 29 and nozzle ring 39) by using different sizes of rivet heads 40 and/or by using different depths of counterbore 32. The smaller the size of the rivet head 40 and/or the greater the depth of the counterbore 32, the less distance the rivet head 40 will extend from the shroud plate 29 and hence the smaller the minimum separation between the shroud plate 29 and nozzle ring 39 will be.

In a second embodiment of the invention shown in FIG. 8 (in which features have been correspondingly numbered in accordance with similar features of the previous embodiment), the turbine housing 1 houses the nozzle ring 39 and attached vanes 14 in an annular recess 41. In order to increase the obstruction of the inlet passageway 9, the nozzle ring 39 is moved towards the bearing housing 3. The bearing housing 3 comprises an annular recess 13 which may receive the vanes 14 as the nozzle ring 39 moves towards the bearing housing 3. Intermediate the recess 13 and the nozzle ring 39 is a shroud plate 29. The shroud plate 29 may be of identical configuration to that of the previously described embodiment. The shroud plate 29 is secured to the bearing housing 3 in an identical manner to that in which the shroud plate 29 is secured to the turbine housing 1 in the previous embodiment. The radially outermost surface of the recess 13 in the bearing housing comprises a groove 28 which receives a support member 33. The support member 33 and shroud plate 29 are riveted together with rivets 37 whilst the shroud plate 29 is in situ.

FIG. 9 shows a schematic axial cross section through part of a bearing housing and a turbine of a turbocharger in accordance with a third embodiment of the invention. Again features which are similar to those discussed in previous embodiments have been correspondingly numbered. In this embodiment, the vanes 14 extend across the inlet passageway 9 from the bearing housing 3 to which they are fixed. A movable wall member 42 is received within an annular recess 41 within the turbine housing. The movable wall member 42 comprises an annular carrier member 43 which has a generally u-shaped axial cross-section and hence defines two circumferential side portions and an intermediate base portion. The carrier member 43 may be considered to be an actuation element because it may be mechanically linked to an actuator (not shown) to enable movement of the movable wall member 42. The carrier member 43 defines an annular opening which faces the vanes 14 of the bearing housing 3. The radially outermost side portion of the carrier member comprises a groove 44 on its radially innermost surface. In an identical manner to that of the previously described embodiments, the groove 44 receives the support member 33. The support member 33 and shroud plate 29 are then riveted together with rivets 37 whilst the shroud plate 29 is in situ. In this way, the shroud plate 29 is secured to the carrier member 43 such that the shroud becomes part of the moveable wall member and such that axial movement of the shroud plate 29 relative to the carrier member 43 is substantially prevented. The carrier member 43 and attached shroud plate 29 define a chamber 45 within the movable wall member 42 which receives the vanes 14 as the movable wall member 42 is moved towards the bearing housing 3.

Although the described embodiments comprise a plurality of corresponding apertures 31, 35 in the shroud plate 29 and support member 33 respectively which are equally angularly spaced, it will be appreciated that any appropriate number or size of corresponding apertures may be used, positioned at any appropriate location on the shroud plate and support member.

The apertures in the shroud plates of the described embodiments are surrounded by a counterbore. It will be appreciated that the counterbore may be of any appropriate size and that in some embodiments of the invention there will be no need for a counterbore.

Whilst rivets are used within the described embodiments to attach the support member to the shroud plate, it will be appreciated that any appropriate fixing element, for example screws or bolts may be used. In some embodiments the corresponding apertures on the shroud plate and the support member may not extend all the way therethrough. For example, one of the corresponding apertures may only extend part way through the shroud plate or support member and may comprise an internal feature (such as a screw thread or the like) on to which a fixing element can anchor.

Although the described embodiments have apertures in the shroud plate and support member which correspond to the size of the fixtures, this need not be the case. For example, the shroud and/or support member may have oversized apertures relative to the fixings such that a degree of relative non-axial movement between the shroud and the support member is accommodated. The accommodation of this movement may help to minimise some of the effects of thermal contraction of the turbine housing relative to the shroud plate 29 when the turbocharger cools down.

Although the described embodiments all comprise a mounting feature (a groove in the examples above) which is on a radially inward facing surface, with the support member attaching to a radially outer part of the shroud plate, it is within the scope of the invention that the mounting feature may be on a radially outward facing surface, with the support member attaching to a radially inner part of the shroud plate. In such an embodiment, the support member would have to flex such that a force could be applied to increase its diameter. Any other appropriate mounting feature may be used.

The described embodiments comprise a resilient support member which flexes within its own plane about a portion of the support member which is opposite a discontinuity (e.g. a gap) in order for it to be inserted into the groove. It is within the scope of the invention to use any appropriate shape of resilient support member which flexes in any appropriate manner such that it can be inserted into the groove or other mounting feature.

In some embodiments, the shroud plate and support member may not be attached together by fixings. The shroud plate and support member may be attached together by welding or brazing.

Whilst the above described embodiments relate to a turbocharger, it will be appreciated that the invention may be applied to any variable geometry turbomachine. One such variable geometry turbomachine is a variable geometry power turbine.

A number of other modifications and alterations may be made to the arrangements described hereinbefore without departing from the scope of the invention.

The invention claimed is:

1. A variable geometry turbomachine comprising:

a housing which defines a bearing housing and an adjacent turbine housing;

a turbine wheel supported in the turbine housing for rotation about a turbine axis;

an annular inlet passage upstream of said turbine wheel defined between respective inlet surfaces of first and second wall members, at least one of said first and second wall members being moveable by an actuation element along the turbine axis to vary the size of the inlet passage;

an array of vanes extending across the inlet passage, said vanes being connected to said first wall member;

a complementary array of vane slots defined by the second wall member, said vane slots being configured to receive said vanes to accommodate relative movement between the first and second wall members;

wherein the second wall member comprises a shroud which defines said vane slots; the second wall member being supported by a generally ring-shaped support member;

wherein a portion of the support member is configured to be received by a corresponding mounting feature such that the support member is retained by the mounting feature;

wherein the mounting feature is provided by one of the bearing housing, the turbine housing or the actuation element; and wherein the shroud is fixed to the support member such that axial movement of the shroud relative to the support member is substantially prevented.

2. The variable geometry turbomachine according to claim 1, wherein the shroud is fixed to the support member by at least one fixing element.

3. The variable geometry turbomachine according to claim 2, wherein the at least one fixing element protrudes towards the first wall member, and wherein the at least one fixing element abuts the first wall member to provide a limit of travel of the first and second wall members relative to one another.

4. The variable geometry turbomachine according to claim 1, wherein the support member comprises at least one axial hole and wherein the shroud comprises at least one corresponding axial hole; the shroud being fixed to the support member by at least one fixing element being received by both the at least one hole in the support member and the at least one corresponding hole in the shroud.

5. The variable geometry turbomachine according to claim 1, wherein the shroud comprises a generally annular plate.

6. The variable geometry turbomachine according to claim 1, wherein the mounting feature of the bearing housing, turbine housing or actuation element comprises a substantially annular groove.

7. The variable geometry turbomachine according to claim 1, wherein the support member is resilient enabling the support member to be compressed to a smaller size and then returned to its original size.

8. The variable geometry turbomachine according to claim 1, wherein the shroud is axially adjacent to the support member.

9. The variable geometry turbomachine according to claim 1, wherein the support member supports the shroud at the outer periphery of the shroud.

10. The variable geometry turbomachine according to claim 1, wherein the support member comprises at least one inwardly directed protuberance relative to the axis.

11. The variable geometry turbomachine according to claim 10, wherein the or each inwardly directed protuberance has an aperture.

12. The variable geometry turbomachine according to claim 1, wherein the support member is discontinuous.

13. The variable geometry turbomachine according to claim 1, wherein an outer diameter of the support member is greater than an outer diameter of the shroud.

14. The variable geometry turbomachine according to claim 1, wherein an inner diameter of the shroud is less than a minimum inner diameter of the support member.

15. The variable geometry turbomachine according to claim 1, wherein the mounting feature and/or the support member is/are adapted to accommodate a degree of relative movement between the support member and either of the bearing housing, turbine housing or actuation member which provides the mounting feature.

16. The variable geometry turbomachine according to claim 1, wherein the shroud is fixed to the support member such that rotation of the shroud relative to the support member is substantially prevented.

17. The variable geometry turbomachine according to claim 1, wherein a minimum inner diameter of the support member is less than an outer diameter of the shroud.

18. The variable geometry turbomachine according to claim 1, wherein the turbomachine is a turbocharger.

19. A variable geometry turbine comprising:

a housing;

a turbine wheel supported in the housing for rotation about a turbine axis;

an annular inlet passage upstream of said turbine wheel defined between respective inlet surfaces of first and second wall members, at least one of said first and second wall members being moveable by an actuation element along the turbine axis to vary the size of the inlet passage;

an array of vanes extending across the inlet passage, said vanes being connected to said first wall member;

a complementary array of vane slots defined by the second wall member, said vane slots being configured to receive said vanes to accommodate relative movement between the first and second wall members;

wherein the second wall member comprises shroud which defines said vane slots; the second wall member being supported by a generally ring-shaped support member;

wherein a portion of the support member is configured to be received by a corresponding mounting feature of the housing or actuation element such that the support member is retained by the mounting feature; and wherein the shroud is fixed to the support member such that axial movement of the shroud relative to the support member is substantially prevented.

* * * * *